US009739276B2

(12) United States Patent
Muth et al.

(10) Patent No.: US 9,739,276 B2
(45) Date of Patent: Aug. 22, 2017

(54) PISTON/CYLINDER UNIT

(71) Applicant: AeroLas GmbH, Unterhaching (DE)

(72) Inventors: Michael Muth, Munich (DE); Georg Slotta, Neufahrn (DE)

(73) Assignee: Aerolas GmbH, Unterhaching (DE)

( * ) Notice: Subject to any disclaimer, the term of this patent is extended or adjusted under 35 U.S.C. 154(b) by 308 days.

(21) Appl. No.: 14/534,950

(22) Filed: Nov. 6, 2014

(65) Prior Publication Data

US 2015/0135944 A1 May 21, 2015

Related U.S. Application Data

(63) Continuation of application No. PCT/DE2013/100171, filed on May 8, 2013.

(30) Foreign Application Priority Data

May 11, 2012 (DE) ..... 10 2012 104 163
May 11, 2012 (DE) ..... 10 2012 104 164
May 11, 2012 (DE) ..... 10 2012 104 165

(51) Int. Cl.

| | |
|---|---|
| ***F01B 21/00*** | (2006.01) |
| ***F04B 53/16*** | (2006.01) |
| ***F04B 39/00*** | (2006.01) |
| ***F04B 39/12*** | (2006.01) |
| ***F04B 53/14*** | (2006.01) |

(52) U.S. Cl.

CPC ..... *F04B 53/162* (2013.01); *F04B 39/0005* (2013.01); *F04B 39/123* (2013.01); *F04B 53/14* (2013.01); *F04B 53/16* (2013.01)

(58) Field of Classification Search

CPC ..... F16J 15/162; Y10S 92/02
USPC ..... 92/DIG. 2
See application file for complete search history.

(56) References Cited

U.S. PATENT DOCUMENTS

| | | | | |
|---|---|---|---|---|
| 3,659,504 | A | 5/1972 | Zurcher | |
| 4,644,851 | A | 2/1987 | Young | |
| 2008/0008610 | A1* | 1/2008 | Muth | F04B 35/045 417/416 |

(Continued)

FOREIGN PATENT DOCUMENTS

| | | | |
|---|---|---|---|
| DE | 102004048944 | A1 | 4/2006 |
| DE | 10 2004 061941 | A1 | 7/2006 |
| JP | H11 2210 | A | 1/1999 |

(Continued)

*Primary Examiner* — Michael Leslie
*Assistant Examiner* — Daniel Collins
(74) *Attorney, Agent, or Firm* — Von Rohrscheidt Patents

(57) ABSTRACT

A piston-cylinder unit including a piston that is fluid pressure supported and movable in a linear manner in a cylinder, wherein the cylinder, a face wall of the piston and a face wall of the cylinder define a compression cavity which is at a minimum size in a portion of a top dead center of the piston, wherein the compression cavity is connected in a fluid transferring manner with a bearing gap which is formed between a cylinder inner circumferential wall and a piston outer circumferential wall, wherein a plurality of fluid outlet nozzles are arranged in at least one cross-sectional plane of the cylinder in the cylinder inner circumferential wall along a circumference, which fluid outlet nozzles open into the bearing gap and are connected with a supply conduit for a pressurized fluid.

26 Claims, 8 Drawing Sheets

(56) References Cited

U.S. PATENT DOCUMENTS

| | | | | |
|---|---|---|---|---|
| 2011/0182758 | A1 | 7/2011 | Yuan | |
| 2013/0167798 | A1* | 7/2013 | Lawler | F02F 1/18<br>123/193.4 |

FOREIGN PATENT DOCUMENTS

| | | | |
|---|---|---|---|
| WO | WO2004005713 | A1 | 1/2004 |
| WO | WO 2004 053331 | A1 | 6/2004 |
| WO | PCT/DE2013/100171 | | 5/2013 |

* cited by examiner

PISTON/CYLINDER UNIT

RELATED APPLICATIONS

This application is a continuation of International patent application PCT/DE2013/100171 claiming priority from German patent applications DE 10 2012 104 163.6, filed on May 11, 2012, DE 10 2012 104 164.4, filed on May 11, 2012, and DE 10 2102 104 165.2, filed on May 11, 2102, all of which are incorporated in their entirety by this reference.

FIELD OF THE INVENTION

The instant invention relates to a piston cylinder unit with a piston that is fluid pressure supported and moveable in a linear manner in a cylinder according to the preamble of patent claim 1.

BACKGROUND OF THE INVENTION

In piston cylinder units of this type there is a risk when a pressure in a compression cavity is greater than a pressure in a bearing gap that the piston is laterally tilted from a position that is coaxial with the cylinder wherein the tilting is caused by fluid from the compression cavity that enters the bearing gap asymmetrically. This changes a thickness of the bearing gap at least partially and rapidly reduces a load bearing capability of the fluid pressure bearing between the cylinder and the piston. In particular when the piston-cylinder unit is configured as a compressor tilt stability for the piston has to be provided.

DE 10 2004 061 904 A1, whose disclosure is incorporated in its entirety by this reference discloses a piston-cylinder unit which provides increased tilting stability for the piston. This known piston cylinder unit is illustrated in FIG. 1 as prior art. This figure illustrates a longitudinal sectional view through a piston cylinder unit 1 with a cylinder 2 and a piston 3. The cylinder is provided with a cylinder bore hole 10 in which the piston 3 is moveable back and forth in a direction of a longitudinal axis X of the cylinder bore hole 10 and received freely supported. The piston 3 is connected through a piston rod 4 with an input or an output which are not illustrated. The cylinder face wall 12 that is configured at a cylinder head 23 and which forms the face side termination of the cylinder bore hole 10, the inner circumferential wall of the cylinder bore hole 10 and the piston face wall 16 define the cylinder volume and define a pressure cavity 18.

An inlet channel 22 provided with a schematically illustrated valve 20 leads into the cylinder face wall 12. An outlet channel 24 is also provided in the cylinder face wall 12, wherein the outlet channel 24 also includes a respective outlet valve 26. Also this outlet channel leads into the cylinder bore hole 10.

When the piston is moved in FIG. 1 to the right up to the dashed position of the piston 3 where it reaches its top dead center TDC where it reverses its movement direction, the fluid that is included in the cylinder volume 18 and which is for example gaseous is compressed when the piston-cylinder unit is a compressor. The cylinder volume 18 then forms a compression cavity. When the outlet valve 26 opens the compressed fluid flows out of the compression cavity 18 through the outlet channel 24, for example to downstream consumers.

A portion of the expelled fluid is conducted out of the outlet channel 24 through a connection channel 28 that is provided in the cylinder head 23 and in the housing 21 of the cylinder 2 into ring channels 30, 32, 34 which are also provided in the housing 21 of the cylinder 2 and which envelop the cylinder bore hole 10 in an annular manner. The ring channels 30, 32, 34 are offset from one another in a direction of the longitudinal axis X of the cylinder bore hole. Each of the ring channels 32, 33, 34 is provided with a plurality of micro holes 30', 32', 34' which are evenly distributed over a circumference of the cylinder bore hole 10 and respectively connect the ring channel 32, 33, 34 with an interior of the cylinder bore hole 10 and thus penetrate the inner circumferential wall 14 of the cylinder. The micro holes 30' 32', 34' of each ring channel 30, 32, 34 thus respectively form an annular nozzle arrangement 30", 32" 34". Pressurized fluid, advantageously pressurized gas which is conducted through the connection channel 28 into the ring channels 30, 32, 34 can thus exit through the micro holes 30', 32' 34' and can form a fluid cushion for example a gas cushion laterally supporting the piston in a bearing gap 19 between a cylinder side bearing surface 15 on an inner circumferential wall 14 of the cylinder 2 and a piston side support surface 38 on an outer circumferential wall of the piston.

The first ring channel 30 that is most proximal to the cylinder face wall 12 and includes associated micro holes 30' is arranged in a portion in which the piston only covers the micro holes 30' only when the piston is arranged proximal to the compression position, thus the top dead center, thus when the cylinder volume 18 is minimized. In this case the piston 3 covers the forward first micro holes 30' with the bearing surface 38 in a front portion 3". This way it is assured that the piston section which is adjacent to the piston face wall 16 is laterally stabilized in its position proximal to the top dead center TDC, so that a risk that the piston is laterally displaced by fluid entering the bearing gap from the compression cavity is essentially excluded.

The second ring channel 22 is arranged so that micro holes 32' associated therewith are always covered by the moving piston 3 so that the micro holes 32' help to form the supporting gas cushion between the inner circumferential wall 14 of the cylinder 2 and the outer circumferential wall 36 of the piston 3 over an entire axial movement path of the piston 3.

The third ring channel 34 is the furthest away from the cylinder face wall 12. The micro holes 34' associated with the third ring channel 34 are thus covered by the piston 3, thus by the support surface 38 in the rear portion 3' of the piston only when the piston 3 is in its retracted position in which the cylinder volume is at a maximum.

This known piston-cylinder unit supports the piston in its forward circumferential portion also in its top dead center position but it cannot be excluded that pressurized fluid that enters the bearing gap from the compression cavity 18 imparts a lateral force upon the piston because a distance between the piston face wall and the impact location of the pressurized bearing fluid exiting from the micro holes 30' varies at the piston circumference due to the piston movement.

DE 10 2008 007 661 A1 shows a linear compressor with a piston-cylinder unit whose piston is driven by a linear motor to perform a reciprocating movement. The piston is gas pressure supported in the cylinder and the cylinder wall is provided with a plurality of nozzle openings for this purpose. The piston is provided with a plurality of slanted bore holes or radial slots at its face side, wherein the slanted bore holes or radial slots extend from a base of the piston to a circumference of the piston. A pressure balancing between the spaces on both sides of the piston shall be provided through the bore holes or slots.

From DE 81 32 123 U1 a gas pressure support of a piston-cylinder unit is known, wherein a fluid connection is provided between the compression cavity and a pressure cavity of the gas bearing.

U.S. Pat. No. 5,140,915 A illustrates and describes a gas supported piston in a piston-cylinder unit in which circumferential grooves are provided in the forward end section wherein the circumferential grooves are introduced into the circumferential wall in an insulated manner. These circumferential grooves are configured to insulate the gas bearing from an oscillating pressure in the compression cavity.

JP 2002 349 435 A discloses a linear compressor with an air supported piston which is provided with a circumferential groove in its center section in axial direction. This circumferential groove provides pressure compensation along the circumference of the piston and thus pressure compensation acting in circumferential direction in the bearing gap. When compressed air moves in this known linear compressor from the compression cavity into the bearing gap at a location of the bearing gap, forces which might cause a tilting of the piston are quickly compensated by the pressure compensation caused by the circumferential groove, so that the piston quickly moves back into its position that is coaxial with the cylinder axis or in an ideal case it does not even leave this position. This circumferential groove does not only weaken the undesirable transversal force, but also the air bearing which reduces load bearing capability of the air bearing.

A piston cylinder unit is known from U.S. Pat. No. 2,907,304 which forms a linear drive device that is actuatable by a fluid. The cylinder wall is provided with a plurality of openings through which a pressurized fluid is introduced into the cylinder cavity. Furthermore switchable fluid outlets are provided at both face sides of the cylinder housing so that alternating opening of respective outlet valves generates a linear movement of the piston.

BRIEF SUMMARY OF THE INVENTION

Thus, it is the object of the present invention to provide a piston cylinder unit which assures a lateral support of the piston in a portion of the piston face wall even in highly dynamic applications, thus when the piston-cylinder unit runs with a high operating frequency even when the piston is in the portion of its top dead center and thus a pressure in the compression cavity is maximized.

The object is thus achieved through a piston-cylinder unit including a piston that is fluid pressure supported and movable in a linear manner in a cylinder, wherein the cylinder, a face wall of the piston and a face wall of the cylinder define a compression cavity which is at a minimum size in a portion of a top dead center of the piston, wherein the compression cavity is connected in a fluid transferring manner with a bearing gap which is formed between a cylinder inner circumferential wall and a piston outer circumferential wall, wherein a plurality of fluid outlet nozzles are arranged in at least one cross-sectional plane of the cylinder in the cylinder inner circumferential wall along a circumference, which fluid outlet nozzles open into the bearing gap and are connected with a supply conduit for a pressurized fluid, wherein a plurality of fluid outlet nozzles which open into the bearing gap are arranged in at least one cross-sectional plane of the piston adjacent to the piston face wall in the piston outer circumferential wall along the circumference, and wherein the fluid outlet nozzles in the piston outer circumferential wall are also connected with the supply conduit for the pressurized fluid.

In this piston cylinder unit a plurality of fluid outlet nozzles is arranged in at least one cross sectional plane of the cylinder in the inner circumferential wall of the cylinder along the circumference, wherein the fluid outlet nozzles lead into the bearing gap and in at least one cross sectional plane of the piston adjacent to the piston face wall a plurality of fluid outlet nozzles is arranged in the piston outer circumferential wall along the circumference wherein the fluid outlet nozzles lead into the bearing gap.

According to the invention also the fluid outlet nozzles in the piston outer circumferential wall are connected with the supply conduit for the pressurized fluid.

This way the piston independently of its position in the cylinder is always supported against the cylinder inner circumferential wall at a front side of the piston that is adjacent to its piston face wall through pressurized fluid exiting from the piston side fluid outlet nozzles. The fluid outlet nozzles are thus covered in any piston position by the opposite surface at the cylinder inner circumferential wall and a distance between the fluid outlet nozzles and the edge of the bearing surface, thus the piston face wall is constant in any piston position. Thus, the piston is much more tilt stable proximal to its top dead center, thus at maximum compression in the compression cavity, than in solutions that are known in the art.

An advantageous embodiment of this piston cylinder unit according to the invention is characterized in that the at least one cross sectional plane of the piston with the fluid outlet nozzles is arranged in any position of the piston that moves back and forth during operation between the at least one cross sectional plane of the cylinder with the fluid outlet nozzles and the cylinder face wall.

This advantageous embodiment provides that the front section that is adjacent to the piston face wall is always supported by the pressurized fluid flowing out of the piston side fluid outlet nozzles, whereas the rear piston section is supported by the pressurized fluid which exits from the cylinder side fluid outlet nozzles.

This object is also achieved with a piston cylinder unit including a piston that is fluid pressure supported and movable in a linear manner in a cylinder, wherein the cylinder, a face wall of the piston and a face wall of the cylinder define a compression cavity which is at a minimum size in a portion of a top dead center of the piston, wherein the compression cavity is connected in a fluid transferring manner with a bearing gap which is formed between a cylinder inner circumferential wall and a piston outer circumferential wall, wherein a plurality of fluid outlet nozzles are arranged in at least one cross-sectional plane of the cylinder in the cylinder inner circumferential wall along the circumference, which fluid outlet nozzles open into the bearing gap, wherein the piston is provided with a ventilation groove configured as a circumferential groove into which a ventilation conduit opens, wherein the ventilation groove is configured in a circumferential section of the piston that is adjacent to the piston face wall, and wherein the ventilation conduit reduces pressurized fluid entering the ventilation groove to a pressure level which is lower than a pressure in the compression cavity when the piston is in its top dead center or when it moves towards the top dead center in proximity to the top dead center.

This piston cylinder unit according to the invention includes a piston that is moveable in a linear manner and which is fluid pressure supported in the cylinder, wherein the cylinder, a face wall of the piston and a cylinder face wall define a compression cavity which is at a minimum in a portion of the top dead center of the piston. This compression cavity is in fluid connection with a bearing gap formed between a cylinder interior circumferential wall and a piston exterior circumferential wall. In at least one transversal plane of the cylinder a plurality of fluid outlet nozzles leads into a bearing gap, wherein the fluid outlet nozzles are arranged in the cylinder circumferential wall along the circumference.

It is provided in order to achieve the object according to the invention that the piston is provided with a circumferential groove that leads into a venting conduit wherein the venting groove is configured in a circumferential section of the piston adjacent to the piston face wall and wherein the venting conduit vents pressurized fluid entering the venting groove to a pressure level that is lower than the pressure in the compression cavity when the piston is in its top dead center or proximal to the top dead center moving towards the top dead center.

By providing a venting conduit of this type in the circumferential groove not only a pressure balancing along the circumference of the piston is provided beyond the teachings of the prior art, thus along the circumference of the bearing gap but beyond that pressurized fluid entering the circumferential groove is vented to a lower pressure level. Therefore pressurized fluid entering the bearing gap from the compression cavity does not pose any barrier for the pressure fluid entering through the micro holes into the bearing gap. This prevents that the load bearing capability of the bearing is degraded when the piston is proximal to the top dead center or in top dead center and the pressure in the compression cavity is much higher than the bearing fluid pressure.

Through arranging the air ventilation groove in a circumferential section of the piston that is adjacent to the piston face wall it is facilitated that pressurized fluid entering into the bearing gap from the compression cavity is already vented immediately after entering the bearing gap so that transversal forces impacting the piston are minimized.

Thus the bearing-pressure fluid can also flow in a direction of the circumferential groove which significantly improves the load bearing capability of the fluid pressure bearing between the piston and the cylinder.

Advantageously the vented air groove is in fluid connection with a space where the lower pressure lever prevails.

Advantageously a pressure compensation circumferential groove is provided between the piston face wall and the ventilation groove, wherein the ventilation groove has the effect that the pressure in the bearing gap along the piston circumference is always compensated and that there is no asymmetric pressure distribution. Thus, the piston always maintains its centered position.

In another advantageous variation of this second embodiment of the invention the piston has a piston section with reduced diameter in the portion of the piston face wall. The ventilation groove is thus provided in the remaining piston portion with a diameter that is not reduced.

Providing the piston section with reduced diameter in the portion of the piston face wall has the effect that the compressed fluid enters from the compression cavity into the ring cavity enveloping the piston section with reduced diameter when the pressure of the compressed fluid in the compression cavity is higher than the pressure in the bearing gap so that the piston is stabilized in its centered position.

It is particularly advantageous when the diameter of the piston section with reduced diameter increases in axial direction of the piston starting from the piston face wall. The compressed fluid entering from the compression cavity into the ring cavity enveloping the piston section with reduced diameter develops radial forces like in an outlet throttled fluid bearing. Thus, it is advantageous when the tightest location of the ring cavity, thus the transition from the piston section with reduced diameter to the piston section with non-reduced diameter is arranged in front of the first fluid outlet nozzles of the pressure fluid bearing for the piston.

The increase of the diameter in the piston section with reduced diameter can be advantageously linear or also nonlinear.

It is also advantageous when a plurality of fluid outlet nozzles is arranged in the piston exterior circumferential wall along a circumference at least in a cross sectional plane of the piston on a side of the ventilation groove that is oriented away from the piston face wall, wherein the fluid outlet nozzles lead into the bearing gap. This way the piston is always supported at its front side adjacent to the piston face wall relative the cylinder circumferential wall irrespective of its position in the cylinder through pressurized fluid exiting from the piston side fluid outlet nozzles. The fluid outlet nozzles are thus covered in each piston position by the opposite surface at the cylinder inner circumferential wall and a distance between the fluid outlet nozzles and an edge of the bearing surface, thus the piston face wall is constant in any position of the piston. Thus, the piston even close to top dead center, thus under maximum compression in the compression cavity, is much more tilt stable than in any prior art solution.

Thus it is advantageous when the at least one cross sectional plane of the piston with the fluid outlet nozzles is arranged in any position of the piston moving back and forth during operations between the at least one cross sectional plane of the cylinder with the fluid outlet nozzles and the cylinder face wall. This advantageous embodiment provides that the forward section that is adjacent to the piston face wall is always supported by the pressurized fluid flowing out of the piston side fluid outlet nozzles, whereas the rear piston section is supported by the pressurized fluid which exits from the cylinder side fluid outlet nozzles.

The object is furthermore achieved in a piston cylinder unit including a piston that is fluid pressure supported and movable in a linear manner in a cylinder, wherein the cylinder, a face wall of the piston and a face wall of the cylinder define a compression cavity which is at a minimum size in a portion of a top dead center of the piston, wherein the compression cavity is connected in a fluid transferring manner with a bearing gap which is formed between a cylinder inner circumferential wall and a piston outer circumferential wall, wherein a plurality of fluid outlet nozzles are arranged in the cylinder inner circumferential wall along a circumference at least in a cross sectional plane of the cylinder where the fluid outlet nozzles open into the bearing gap, and wherein a section of the bearing gap that is adjacent to the compression cavity has a greater radial extension than a section of the bearing gap that is oriented away from the compression cavity, at least when the piston approaches top dead center.

In order to achieve the object is provided in this piston cylinder unit that a plurality of fluid outlet nozzles is arranged in the cylinder inner circumferential wall along the circumference in at least one cross sectional plane of the cylinder, wherein the fluid outlet nozzles lead into the bearing gap, and wherein a section of the bearing gap that is adjacent to the compression cavity has a greater redial extension than the section of the bearing gap that is oriented away from the compression cavity at least when the piston approaches drop dead center.

The configuration of the piston cylinder unit wherein a section of the bearing gap that is adjacent to the compression cavity has a greater radial extension than the section of the bearing gap oriented away from the compression cavity has the effect that the compressed fluid from the compression cavity enters the section of the bearing gap with greater radial extension along the entire piston circumference when the pressure of the compressed fluid in the compression cavity is greater than the pressure in the bearing gap which stabilizes the piston in its centered position. The compressed fluid entering in this section of the bearing gap with greater radial extension from the compression cavity develops radial forces in this portion like an outlet throttled fluid bearing, as soon as the pressure of the compressed fluid is greater than the pressure in the bearing gap.

Advantageously the section of the bearing gap with greater radial extension is formed by a piston section with reduced diameter. Tests have shown that it is already sufficient when the diameter differential between the piston section with reduced diameter and the remaining piston section is less than 5%, advantageously less than 1% of the non-reduced piston diameter.

It is particularly advantageous when the diameter of the piston section with reduced diameter increases from the piston face wall in axial direction of the piston. The compressed fluid entering from the compression cavity into the ring cavity enveloping the piston section with reduced diameter develops radial forces like in an outlet throttled fluid bearing. Thus, it is helpful when the tightest spot of the ring cavity, thus the transition from the piston section with reduced diameter to the piston section with non-reduced diameter is arranged in front of the first fluid outlet nozzles of the pressure fluid bearing for the piston.

The increase of the diameter in the piston section with reduced diameter can be advantageously linear or nonlinear.

Alternatively the section of the bearing gap with greater radial extension can also be formed by a cylinder section with expanded diameter.

Thus it is advantageous when the diameter of the cylinder section with increased diameter decreases starting from the cylinder face wall in axial direction of the cylinder.

This decrease of the diameter in the cylinder section with expanded diameter is advantageously linear, however it can also be nonlinear.

An advantageous embodiment of this piston cylinder unit according to the invention is characterized in that in at least one cross sectional plane of the piston, adjacent to the piston face wall or to the face side piston section with reduced diameter, a plurality of fluid outlet nozzles is arranged in the piston outer circumferential wall along the circumference, wherein the fluid outlet nozzles lead into the bearing gap. This way the piston, irrespective of its position in the cylinder is always supported relative to the cylinder inner circumferential wall through pressurized fluid exiting from the piston side fluid outlet nozzles in a forward portion of the piston that is adjacent to the section of the bearing gap with greater radial extension. The fluid outlet nozzles are thus covered in each piston position by the opposite surface at the cylinder inner circumferential wall and the distance between the fluid outlet nozzles and the edge of the bearing surface of the piston, thus the piston face wall or the transition between the piston outer circumference into the section with reduced diameter is constant in any piston position. Thus, the piston is much more tilt stable than in the solutions known in the art also proximal to top dead center, thus under maximum compression in the compression cavity.

Thus, it is advantageous when at least a cross sectional plane of the piston with the fluid outlet nozzles in any position of the piston moving back and forth during operations is arranged between the at least one cross sectional plane of the cylinder in the fluid outlet nozzles and the cylinder face wall. This advantageous embodiment provides that the forward piston section is always supported by pressurized fluid flowing out of the piston side outlet nozzles, whereas the rear piston section is supported by the pressurized fluid which exits from the cylinder side outlet nozzles.

Another advantageous variation of the third embodiment of the piston cylinder unit according to the invention is characterized in that the piston in a circumferential section that is adjacent to the piston face wall or the piston section with reduced diameter is provided with at least one circumferential groove. This circumferential groove forms a circumferential pressure compensation groove which provides that pressure differences along the circumference of the bearing gap which can be generated for example through asymmetrically entering pressurized fluid from the compression cavity are directly balanced so that the piston remains in its position that is centered about the cylinder longitudinal axis X and is not laterally displaced.

It is furthermore advantageous when at least one circumferential groove of the piston is configured as a ventilation groove into which a ventilation conduit leads. Thus, pressurized fluid entering into the bearing gap from the compression cavity can be ventilated through the ventilation groove and the ventilation conduit.

Thus, the ventilation conduit is advantageously connected in a fluid conducting manner with a space in which a fluid pressure prevails which is lower than the pressure in the compression cavity when the piston is in its top dead center or moves towards top dead center. This prevents that the load bearing capability of the bearing degrades when the piston is proximal to top dead center or in top dead center and the pressure in the compression cavity is much higher than the bearing fluid pressure.

Advantageously the ventilation groove is configured in a circumferential section of the piston that is adjacent to the piston face wall.

BRIEF DESCRIPTION OF THE DRAWINGS

The invention is subsequently described in more detail based on embodiments with reference to the drawing figure, wherein.

DETAILED DESCRIPTION OF THE INVENTION

Figure 1:
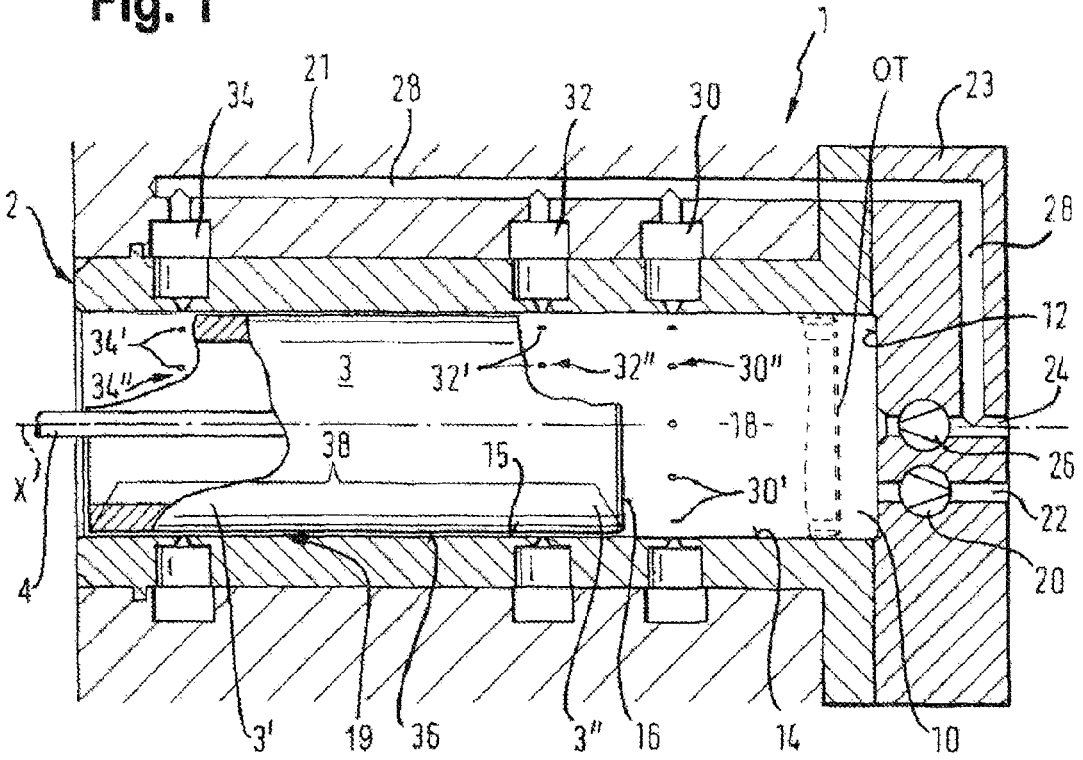
FIG. 1 illustrates a prior art piston cylinder unit.

FIG. 1 illustrates the prior art piston cylinder unit according to DE 10 2004 061 904 A1 that is already described in the introduction of the description.

Figure 2:
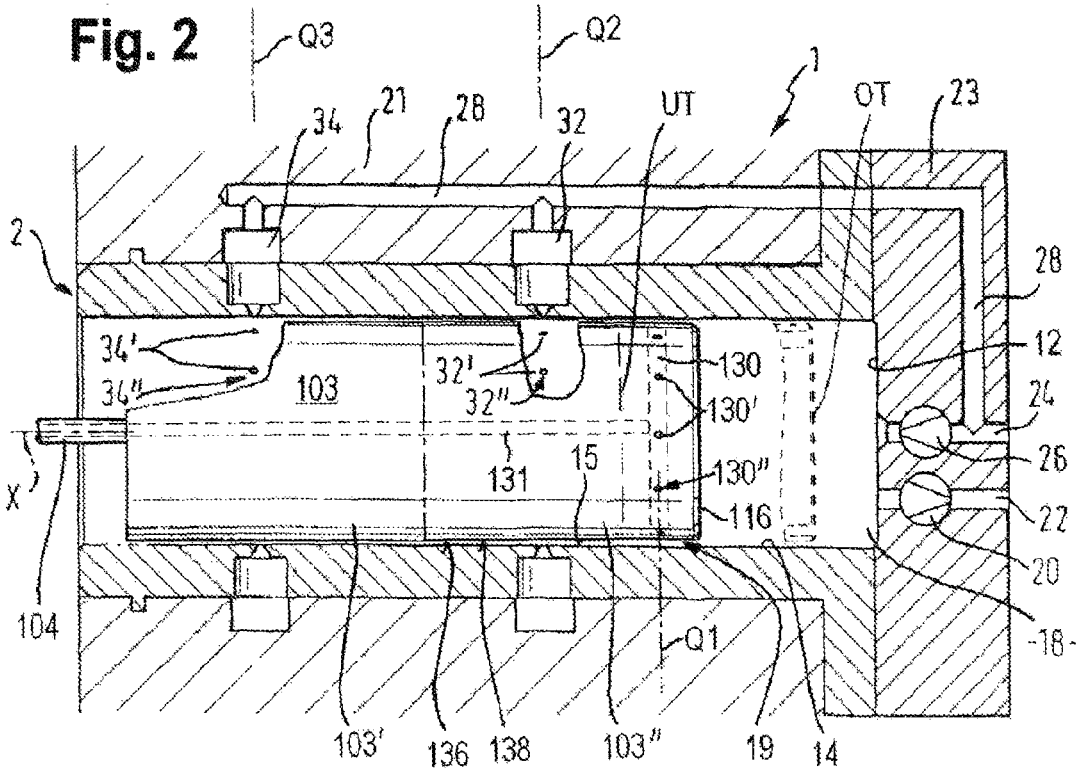
FIG. 2 illustrates a piston cylinder unit according to a first embodiment of the invention.

FIG. 2 illustrates a first embodiment of the piston cylinder unit according to the invention, wherein the same reference numerals are used for the elements in FIG. 2 that are identical to the elements in FIG. 1.

The piston 103 is arranged in a center position between its bottom dead center UT and its top dead center OT. The second ring channel 32 and the third ring channel 34 are arranged in the cylinder similar to the piston cylinder unit illustrated in FIG. 1. The position of the micro holes 32' associated with the second ring channel 32 and forming fluid outlet nozzles in the cross sectional plane Q2 and the position of the micro holes 34' associated with the third ring channel 34 and forming fluid outlet nozzles in the cross sectional plane Q3 and the distance between the second annular nozzle arrangement 32" and the third annular nozzle arrangement 34" in axial direction are selected so that the micro holes 32' and 34' are covered by the circumferential wall 136 of the piston 103 during the entire axial movement of the piston 103. The two cylinder side air bearings, namely the second air bearing formed by the second annular nozzle arrangement 32" and the third air bearing formed by the third annular nozzle arrangement 34" are thus active during the entire piston movement and support the piston 103 in a rear piston section 103' and in a forward piston section 103" in radial direction.

The first air bearing contrary to the embodiment of FIG. 1 is not configured in the cylinder but in the piston 103. Thus, the piston 103 is provided with micro holes 130' distributed over the circumference, evenly offset and forming fluid outlet nozzles in the piston outer circumferential wall 136 in a cross sectional plane Q1 directly adjacent to the piston face wall 116, wherein the micro holes lead into a ring channel 130 configured in an interior of the piston 103 and form a first forward annular nozzle arrangement 130". The ring channel 130 in the interior of the piston 103 is connected through a channel 131 extending in an interior of the piston rod 104 and through a non-illustrated supply conduit with the connection channel 28. The pressurized fluid flowing into the connection channel 28 is thus also conducted into the ring channel 130 in the interior of the piston and flows from the first micro holes 130' into the bearing gap 19.

This way a fluid bearing, for example an air bearing is formed in the most forward portion of the forward piston section 103" of the piston 103 by the annular nozzle arrangement 130" provided at this location, wherein the air bearing supports the piston 103 radially directly adjacent to the piston face wall 16 relative to the cylinder inner circumferential wall 14 forming the bearing surface 15. Since this most forward fluid bearing moves with the piston the forces applied in this area for radially supporting the piston 103 are almost constant over the entire piston movement. Laterally deflecting the piston transversal to the longitudinal axis X is therefore almost impossible even when fluid compressed in the compression cavity 18 penetrates under pressure into the bearing gap 19.

Figure 3:
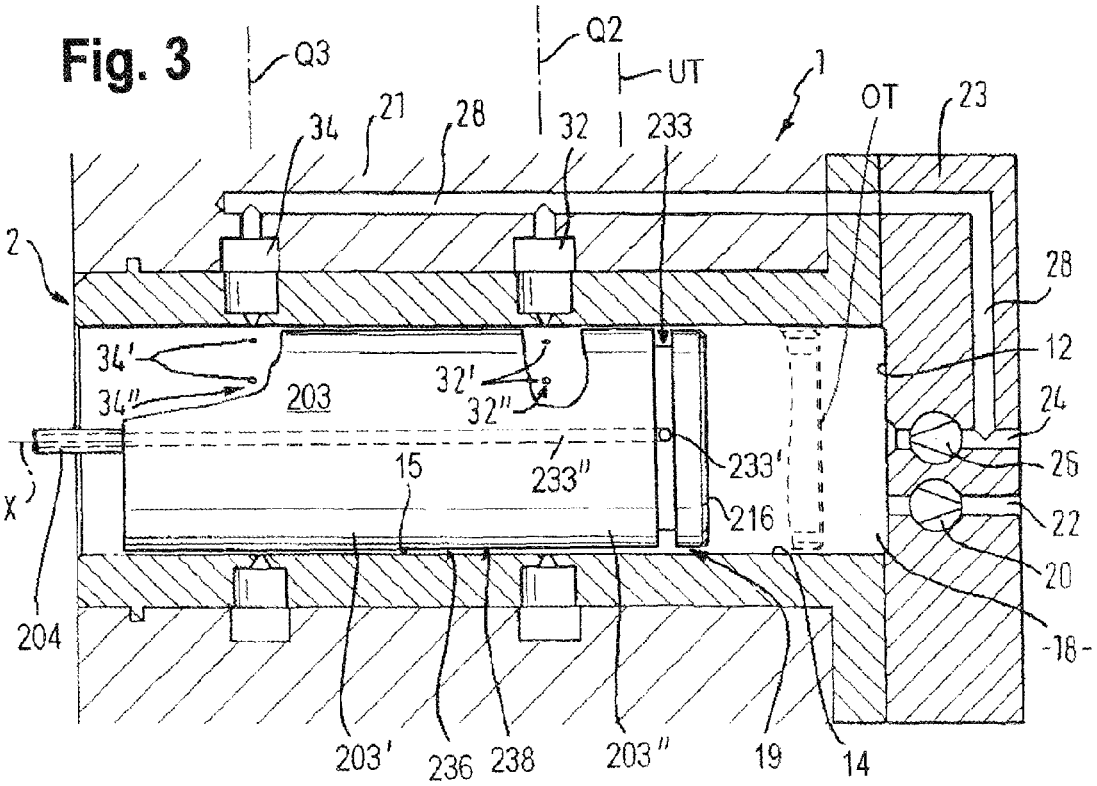
FIG. 3 illustrates a first variant of a second embodiment of a piston cylinder unit according to the invention.

FIG. 3 illustrates a second embodiment of the piston cylinder unit according to the invention, wherein identical reference numerals are used for the elements in FIG. 3 that are identical with FIG. 1.

The piston 203 is illustrated in a center position between its bottom dead center UT and its top dead center TDC. The second ring channel 32 and the third ring channel 34 are arranged in the cylinder similar to the piston-cylinder unit illustrated in FIG. 1. A position of the micro holes 32' associated with the second ring channel 32 forming fluid outlet nozzles in the cross sectional plane Q2 and a position of the micro holes 34' forming fluid outlet nozzles in the cross sectional plane Q3 and associated with the third ring channel and a distance between the second annular nozzle arrangement 32" and the third annular nozzle arrangement 34" in axial direction are selected so that the micro holes 32' and 34' are covered during the entire axial movement of the piston 203 by the outer circumferential wall 236 of the piston 230. The two cylinder side air bearings, namely the second air bearing formed by the second annular nozzle arrangement 32' and the third air bearing formed by the third annular nozzle arrangement 34" are thus active during the entire piston movement and support the piston 203 in a rear piston section 203' and in a forward piston section 203" in radial direction.

The piston 203 is provided with a circumferentially extending ventilation groove 233 in a forward piston section 203" in the piston outer circumferential wall 236 directly adjacent to the piston face wall 216, wherein a ventilation opening 233' leads into the ventilation groove 233 wherein the ventilation opening is provided with a fluid connection through a channel 233" which extends in an interior of the piston rod 204 with a space in which a fluid pressure prevails which is lower than the pressure in the compression cavity 18 when the piston 203 is in its top dead center TDC or moves towards its top dead center TDC; at least the pressure provided in the ventilation air groove 233 must be lower than the pressure in the bearing gap 19 in front and behind the ventilation groove 233.

Figure 4:
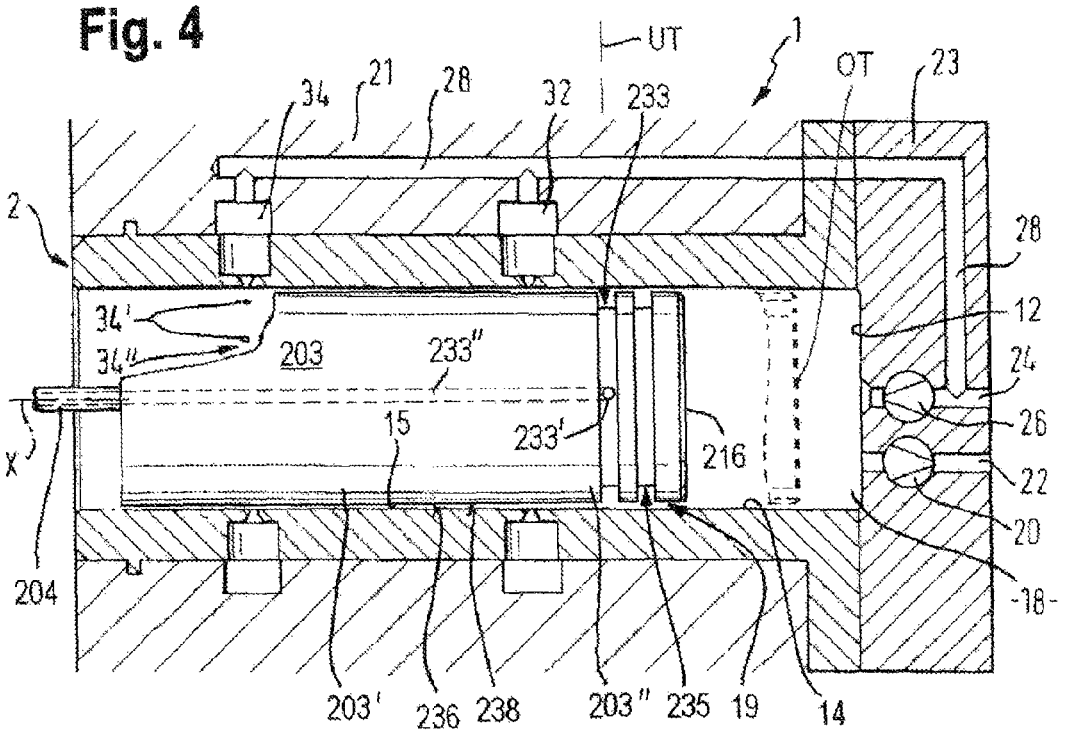
FIG. 4 illustrates a second variant of the second embodiment of the piston cylinder unit according to the invention.

FIG. 4 illustrates a variation of the embodiment according to FIG. 3 in which another circumferential groove 235 is configured in the piston outer circumferential wall 236 between the piston face wall 216 and the ventilation groove 233 directly adjacent to the piston face wall 216. This additional circumferential groove 235 forms a pressure balancing circumferential groove which provides that a pressure compensation along the circumference of the piston 203 is provided in the pressurized fluid entering the bearing gap 19 on one side from the compression cavity 18 so that the piston remains in its centered position with reference to the cylinder axis X and is not displaced laterally.

Figure 5:
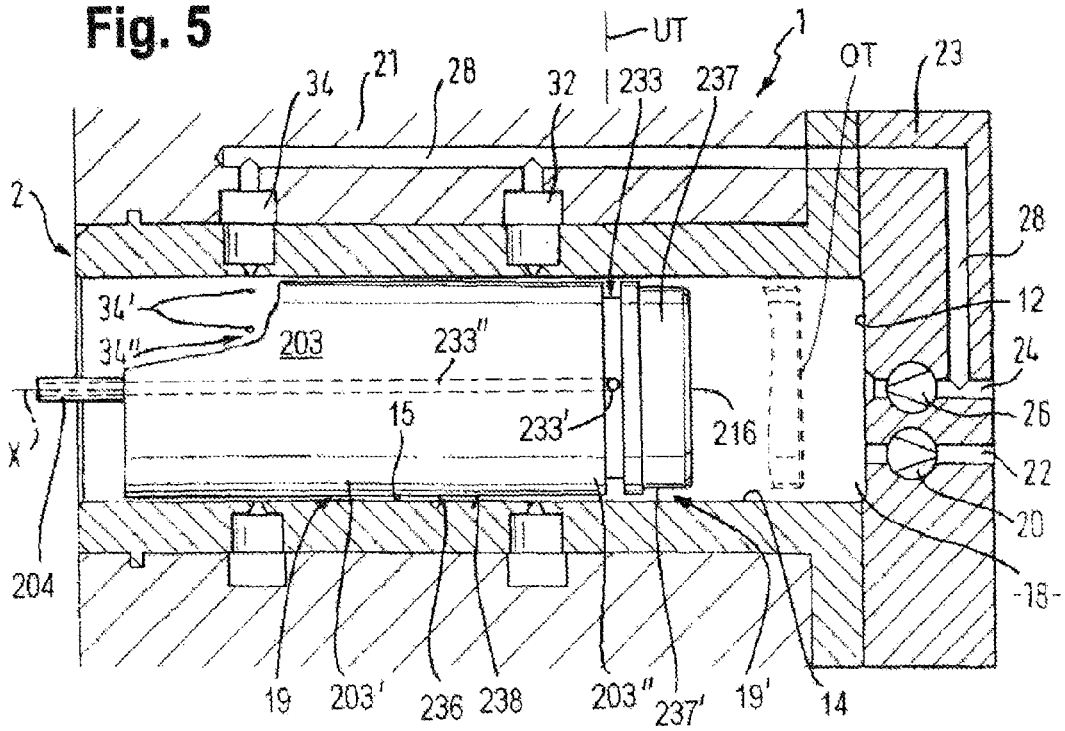
FIG. 5 illustrates a third variant of the second embodiment of the piston cylinder unit according to the invention.
Figure 6:
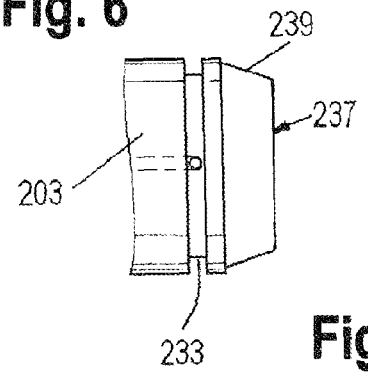
FIG. 6 illustrates a piston of the third variant of the second embodiment with a conical front end section.

FIG. 5 illustrates another variant of the piston 203 provided with the ventilation groove 233 in which the piston 203 in its forward piston section 203" in the portion of the piston face wall 216 includes a piston section 237 with reduced diameter. This piston section 237 with reduced diameter is offset from the ventilation groove 233 in axial direction so that the ventilation groove 233 is configured in the remaining portion of the forward piston portion 203" with a non-reduced diameter.

By providing the piston section 237 with reduced diameter an annular gap 19' is provided between the cylinder inner circumferential wall 14 and the outer circumferential wall 237' of the piston section 237 with reduced diameter, wherein a radial extension of the annular gap, thus its radial thickness is greater than a thickness of the bearing gap 19. When compressed fluid exits during the compression movement of the piston 203 from the compression cavity 18 into the forward ring cavity 19' the pressurized fluid entering the annular gap 19 centers the piston 203.

Figure 7:
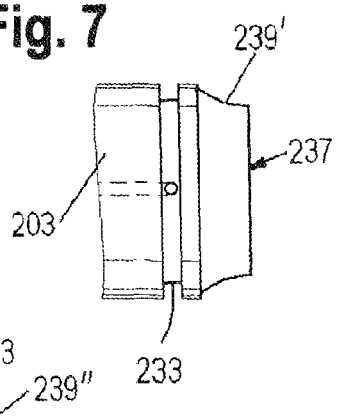
FIG. 7 illustrates a piston of the third variant of the second embodiment with concave front end section.
Figure 8:
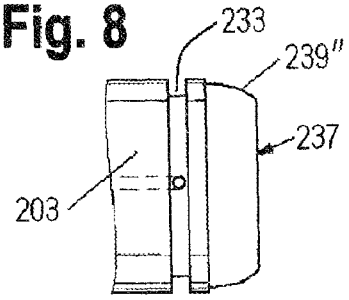
FIG. 8 illustrates a piston of the third variant of the second embodiment with convex forward end section.

In the variant according to FIG. 5 the piston section 237 with the reduced diameter is configured cylindrical. The piston section 237 however can also be configured with increasing diameter starting from the piston face wall 216 in axial direction of the piston. This can be for example implemented as piston section with a conical circumferential contour 239 as illustrated in FIG. 1, wherein the increase of the diameter in the piston section 237 with reduced diameter is linear. The increase of the diameter in the piston section 237 with reduced diameter however can also be nonlinear as illustrated in FIGS. 7 and 8. Thus, the piston section can also have a concave circumferential contour 239' (FIG. 7) or a convex circumferential contour 239" (FIG. 8).

The configuration of the piston 203 with the forward piston section 237 with reduced diameter can also be provided in the variant illustrated in FIG. 4 of the piston with an additional pressure compensation circumferential groove 235.

Figure 9:
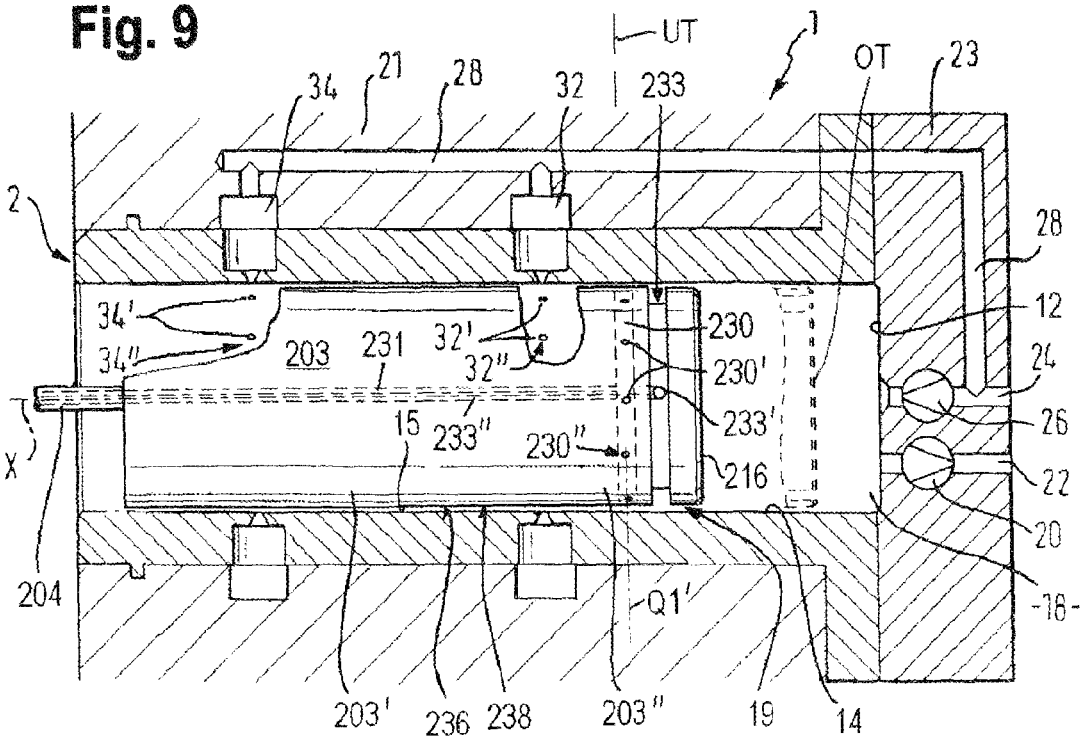
FIG. 9 illustrates a fourth variant of the second embodiment of the piston cylinder unit according to the invention.

By the same token as illustrated in FIG. 9 the piston 203 that is provided according to the invention with the ventilation groove 233 can be additionally provided with a forward piston side fluid bearing in its embodiments according to FIGS. 3-8 described herein.

Thus, the piston 203 is provided with micro holes 230' distributed over the circumference and forming fluid outlet nozzles evenly offset from one another in a cross sectional plane Q1' in the piston exterior circumferential wall 236 directly adjacent to the ventilation groove 233 but axially offset therefrom on a side of the ventilation groove 233 that is oriented away from the piston face wall 216. These micro holes 230' lead into a ring channel 230 configured in an interior of the piston 203 and form a first forward annular nozzle arrangement 203". The ring channel 240 in the interior of the piston 203 is connected with the connection channel 28 through a channel 231 that also extends in an interior of the piston rod 204 and through a non-illustrated supply conduit. The pressurized fluid flowing into the connection channel 28 is thus also run into the ring channel 230 in the interior of the piston 203 and flows from the first micro holes 230' into the bearing gap 19.

This way a fluid bearing, for example an air bearing is also formed in the forward piston section 203 by the annular nozzle arrangement 230" provided at this location wherein the fluid bearing supports the piston 203 in the forward piston section 203" in radial direction against the cylinder inner circumferential wall 14 forming the bearing surface 15. Since the forward fluid bearing moves with the piston the forces applied in this portion for the radial support of the piston 203 are almost constant over the entire piston movement. A lateral displacement of the piston transversal to the longitudinal axis X is therefore almost impossible even when an asymmetrical entry of compressed fluid from the compression cavity 18 into the bearing gap should occur in spite of the additional measures described supra (pressure compensation circumferential groove 235, piston section 237 with reduced diameter).

Figure 10:
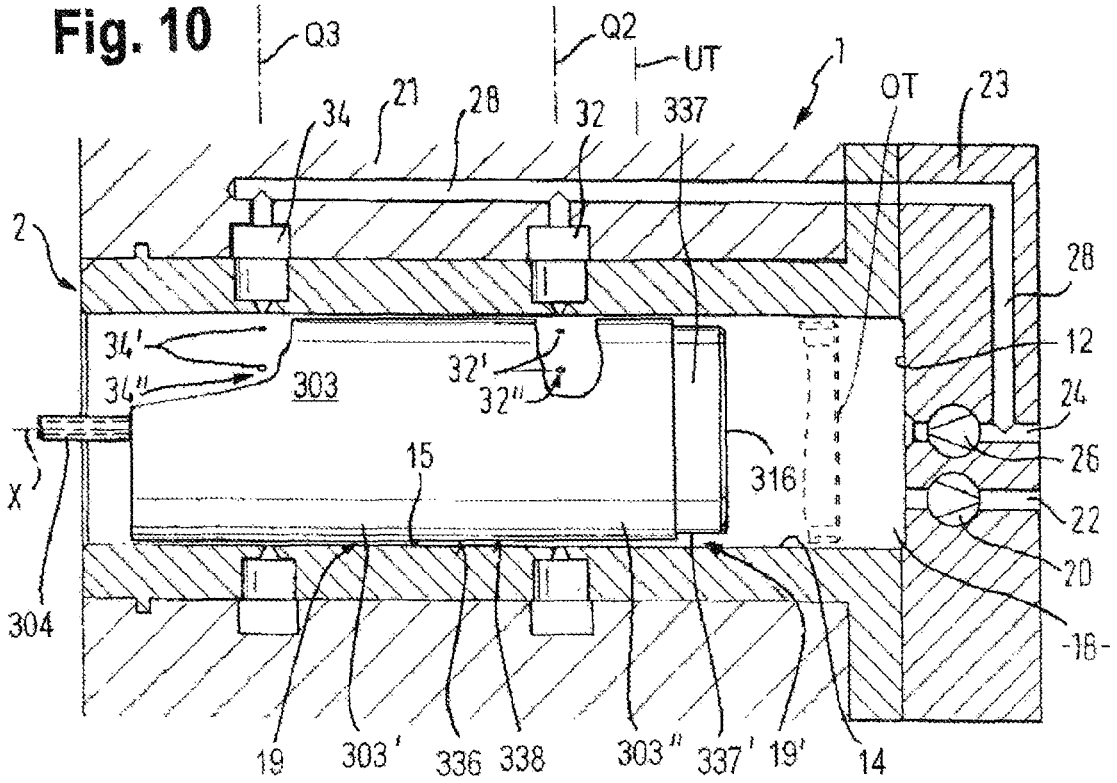
FIG. 10 illustrates a first variant of a third embodiment of the piston cylinder unit according to the invention.

FIG. 10 illustrates a third embodiment of the piston cylinder unit according to the invention, wherein identical reference numerals are used for elements of FIG. 10 that are identical with FIG. 1.

The piston 303 is illustrated in a center position between its bottom dead center UT and its top dead center TDC. The second ring channel 32 and the third ring channel 34 are arranged in the cylinder similar to the piston-cylinder unit illustrated in FIG. 1. The position of the micro holes 32' associated with the second ring channel 32 and forming fluid outlet nozzles in the cross sectional plane Q2 and the position of the micro holes 34' associated with the third ring channel 34 and forming fluid outlet nozzles in the cross sectional plane Q3 and the distance between the second annular nozzle arrangement 32" and the third annular nozzle arrangement 34" in axial direction are selected so that the micro holes 32' and 34' during the entire axial movement of the piston 303 are covered by the exterior circumferential wall 336 of the piston 303. The two cylinder side air bearings, namely the second air bearing formed by the second annular nozzle arrangement 32" and the third air bearing formed by the third annular nozzle arrangement 34" are thus active during the entire piston movement and support the piston 303 in a rear piston section 303' and in a forward piston section 303" in radial direction.

The piston 303 is provided with a piston section 337 with reduced diameter in its forward piston section 303" in the portion of the piston face wall 316, wherein the bearing gap 19 in this section forms an annular gap 19' with a greater radial extension than the section of the bearing gap 19 oriented away from the compression cavity 18.

Providing the piston section 337 with reduced diameter provides an annular gap 19' between the cylinder inner circumferential wall 14 and the outer circumferential wall 337' of the piston section 337 with reduced diameter, wherein the radial extension of the annular gap, thus its radial thickness is greater than the radial thickness of the bearing gap 19. When pressurized fluid enters into the forward annular gap 19' from the compression cavity 18 during the compression movement of the piston 303 the pressurized fluid entering the annular gap 19 centers the piston 303.

Figure 11:
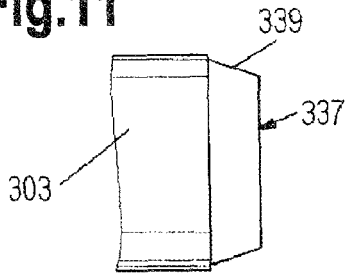
FIG. 11 illustrates a piston of the first variant of the third embodiment with conical forward end section.
Figure 12:
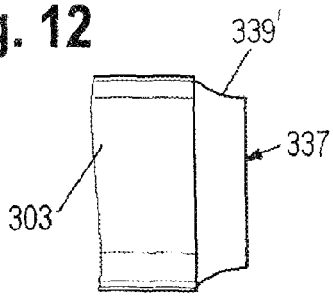
FIG. 12 illustrates a piston of the first variant of the third embodiment with concave forward end section.
Figure 13:
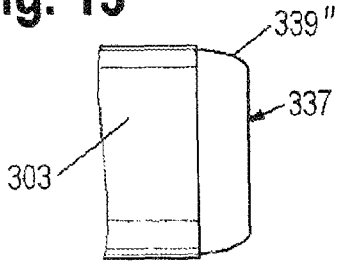
FIG. 13 illustrates a piston of the first variant of the third embodiment with convex forward end section.

In the embodiment according to FIG. 10 the piston section 337 is configured cylindrical with a reduced diameter. However, the piston section 337 can also be provided with an increased diameter in axial direction of the piston starting from the piston face wall 316. This can be implemented for example as a piston section with a conical circumferential contour 339 as illustrated in FIG. 11 wherein the increase of the diameter in the piston section 337 with reduced diameter is linear. This increase of the diameter in the piston section 337 with reduced diameter, however, can also be nonlinear as illustrated in FIGS. 12 and 13. The piston section 337 can also include a concave circumferential contour 339' (FIG. 12) or a convex circumferential contour 339" (FIG. 13).

Figure 14:
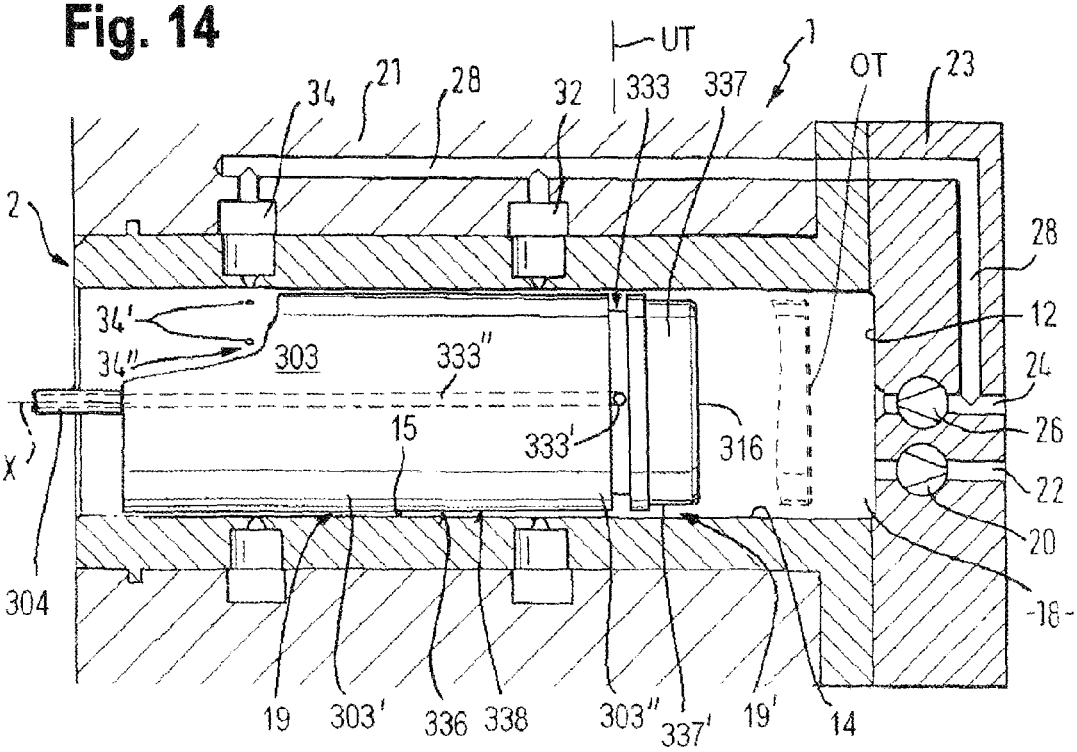
FIG. 14 illustrates a piston cylinder unit according to the invention with a piston of the first variant of the third embodiment which includes a ventilation groove.

FIG. 14 illustrates another variant of the piston 303 provided with the piston section 337 with reduced diameter. The piston 303 in its forward piston section 303" adjacent to the piston section 337 with reduced diameter is provided with a ventilation groove 333 extending along the circumference wherein the ventilation groove leads into a ventilation opening 333' which is in fluid connection through a channel 333" in the interior of the piston rod 304 with a cavity in which a fluid pressure is provided which is lower than the pressure in the compression cavity 18 when the piston 303 is in its top dead center TDC or when it moves towards the top dead center TDC; at least the pressure prevailing in the ventilation groove 333 has to be lower than the pressure in the bearing gap 19 in front and behind the ventilation groove 333. The ventilation groove 333 is offset in axial direction from the piston section 337 with reduced diameter so that the ventilation groove 333 is not configured with the reduced diameter in the remaining portion of the forward piston portion 303".

Figure 15:
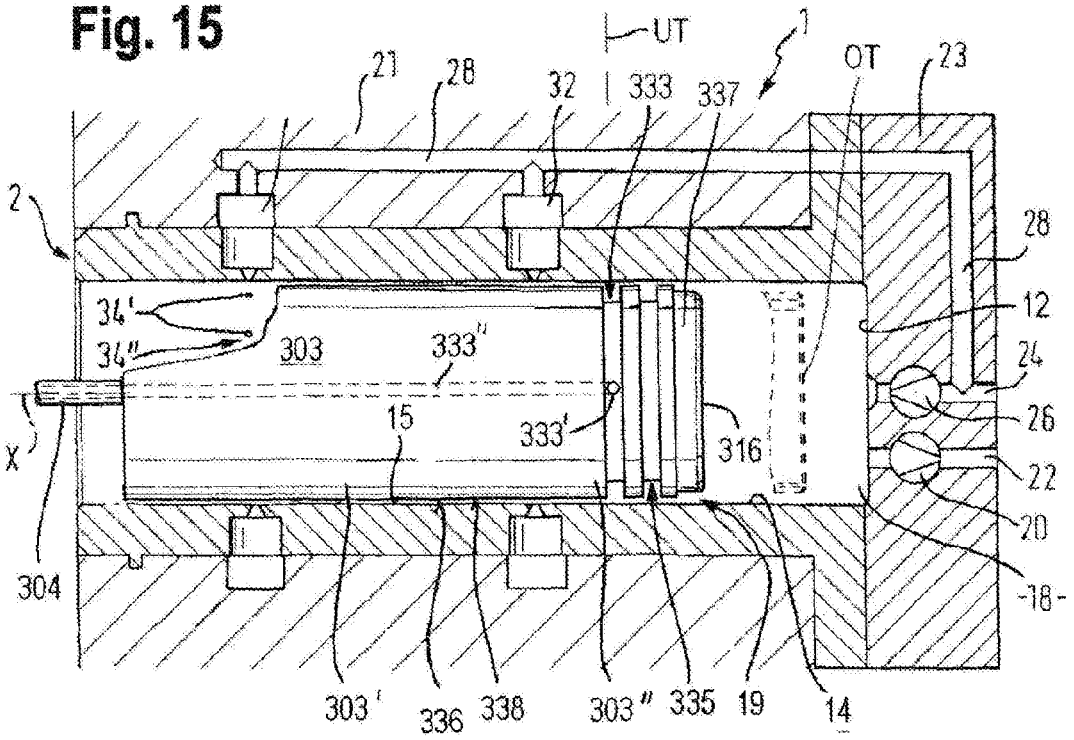
FIG. 15 illustrates the variant of FIG. 14 wherein the piston includes an additional pressure compensation circumferential groove.

FIG. 15 illustrates a variation of the embodiment according to FIG. 14 in which an additional circumferential groove 335 is configured in the piston outer circumferential wall 336 adjacent to the piston section 337 with reduced diameter between the piston section 337 with reduced diameter and the ventilation groove 333. This additional circumferential groove 335 forms a pressure balancing circumferential groove which provides a pressure balancing in the pressurized fluid entering from the compression cavity 18 on one side into the bearing gap 19, wherein the pressure balancing is provided along the circumference of the piston 303 so that the piston remains in its centered position with reference to the cylinder axis X and is not laterally displaced.

Figure 16:
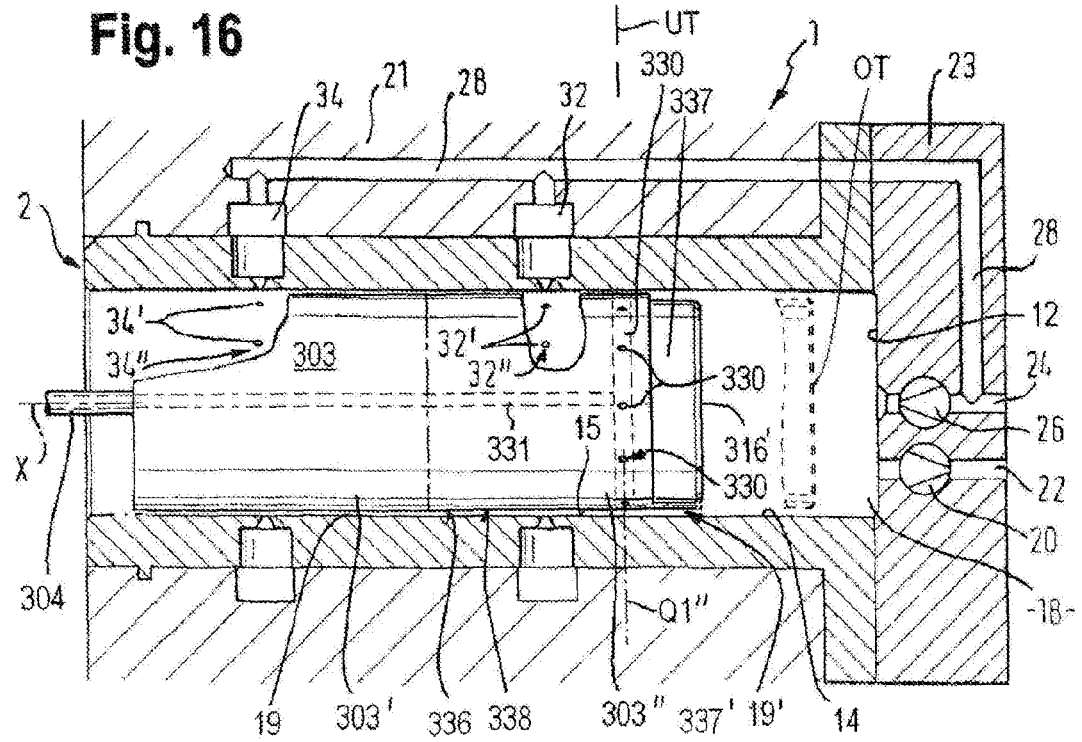
FIG. 16 illustrates a piston cylinder unit of the first variant of the third embodiment with a piston which is provided with a piston side fluid pressure bearing in the forward piston section.

FIG. 16 illustrates another alternative embodiment of the piston cylinder unit according to the invention in which the piston 303 includes a piston side fluid bearing in its forward piston section 303" adjacent to the piston section 337 with reduced diameter.

For this purpose the piston 303 is provided with micro holes 330' that are distributed over the circumference and evenly offset from one another and which form fluid outlet nozzles in a transversal plane Q1" in the piston outer wall 336 directly adjacent to the piston section 337 with reduced diameter but offset there from. These micro holes 330' lead into a ring channel 330 configured in an interior of the piston 303 and form a first forward annular nozzle arrangement 330". The ring channel 330 in the interior of the piston 303 is connected with the connection channel 28 through a channel 331 extending in an interior of the piston rod 304 and through a non illustrated supply conduit. The pressurized fluid flowing into the connection channel 28 is also conducted into the ring channel 330 in an interior of the piston 303 and flows from the first micro holes 330' into the bearing gap 19.

Figure 17:
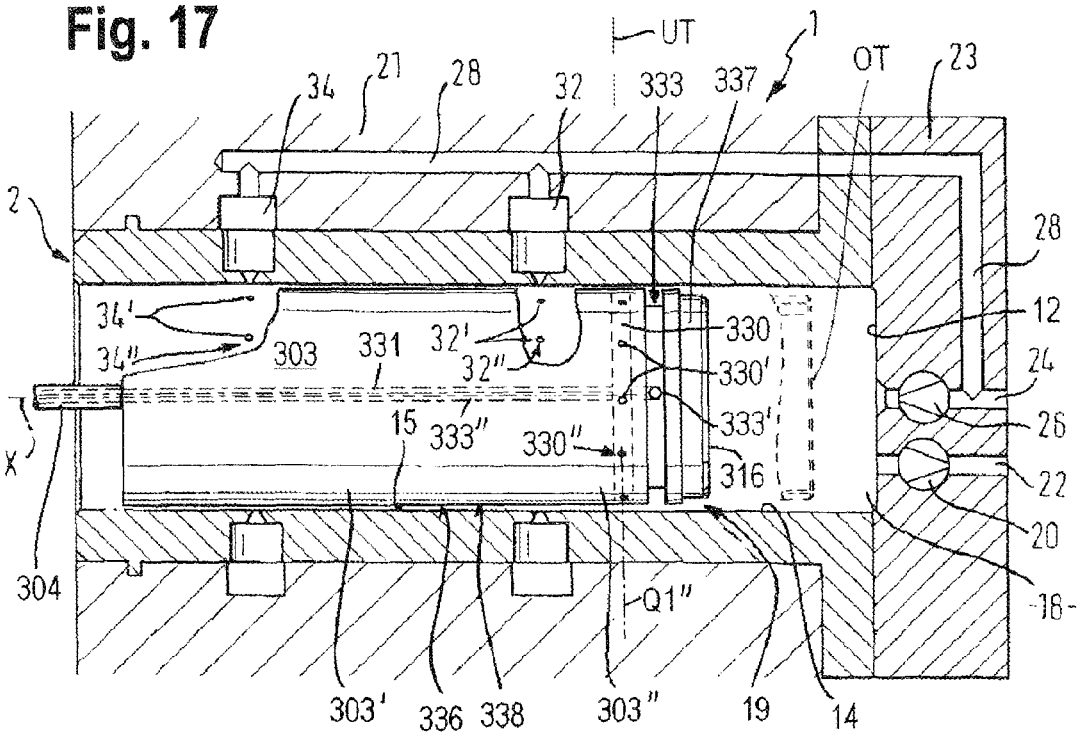
FIG. 17 illustrates the piston cylinder unit of FIG. 16, wherein the piston is provided with an additional ventilation groove.

As illustrated in FIG. 17 the piston 303 that is illustrated in FIG. 16 and which is provided with the piston side air bearing can be additionally provided with a ventilation groove 333 as described in the context of FIGS. 14 and 15. In addition to or as an alternative to the ventilation groove 333 also the pressure compensation circumferential groove 335 can be provided which is described in the context with FIG. 15. The ventilation groove 333 and also the pressure compensation circumferential groove 335 are configured between the piston section 337 with reduced diameter and the forward annular nozzle arrangement 330" in the portion of the piston 303 which does not have a reduced diameter.

This way a fluid bearing, for example a gas or air bearing is also formed in the forward piston section 303" by the annular nozzle arrangement 330" provided at this location, wherein the gas or air bearing supports the piston 303 in the forward piston section 303" in radial direction relative to the cylinder inner circumferential wall 14. Since this forward fluid bearing moves with the piston, forces applied for a radial support of the piston 303 in this area are almost constant over the entire piston movement. A lateral displacement of the piston transversal to the longitudinal axis X is therefore almost impossible even in case compressed fluid enters in an asymmetric manner from the compression cavity 18 into the bearing gap in spite of the additional measures recited supra, thus the pressure compensation circumferential groove 335 and piston section 337 with reduced diameter.

Figure 18:
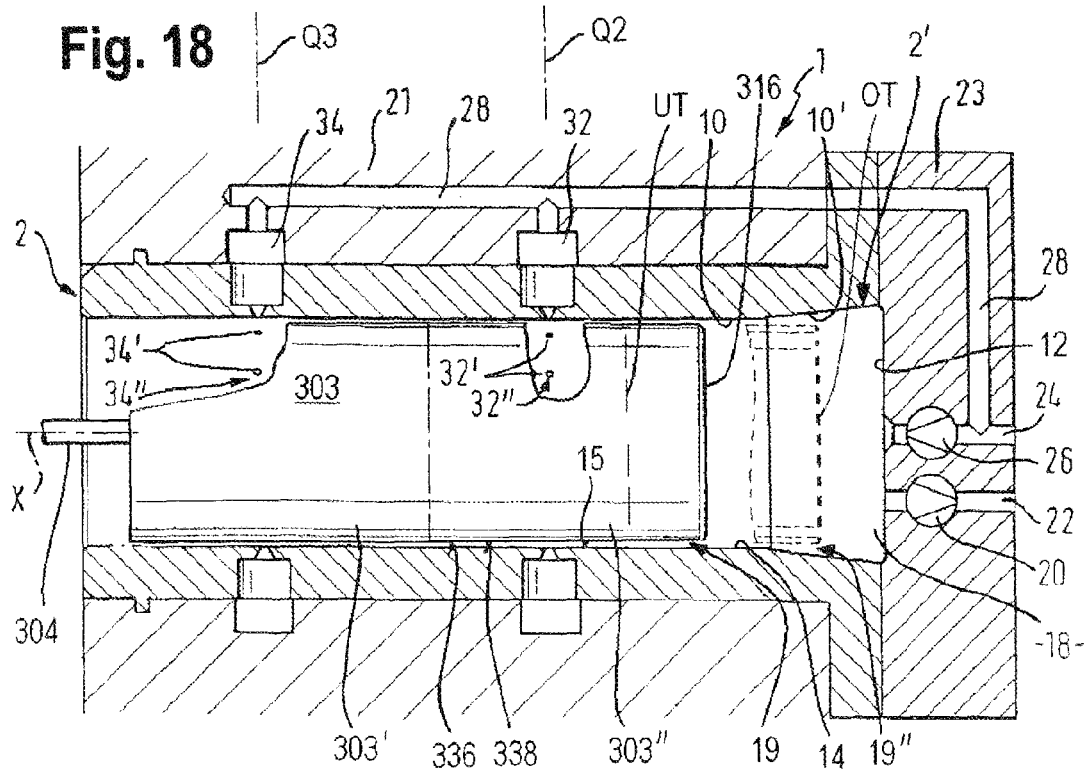
FIG. 18 illustrates a second variant of the third embodiment of the piston cylinder according to the invention with a cylinder section with expanded diameter.

Eventually FIG. 18 illustrates a second variation of the third embodiment of the piston cylinder unit according to the invention in which the section 19" of the bearing gap 19 with greater radial extension is formed by a forward portion 10' of the cylinder bore hole 10 that is arranged proximal to the cylinder face wall 12 in which portion the cylinder bore hole 10' is increased in diameter towards the cylinder face wall 12 (cylinder section 2'). This portion 10' of the cylinder bore hole with increasing or increased diameter envelops at least a portion of the forward piston section 303' of the piston 303 when the piston as represented in FIG. 18 in dashed lines is in its top dead center TDC.

In the variant of the third embodiment of the piston cylinder unit illustrated in FIG. 18 it is not required that the piston is provided with the piston section 337 with reduced diameter in the portion of its piston face wall, though this is not impossible either.

Also in the variant according to FIG. 18, the piston 303 can be provided with a ventilation groove 333, a pressure compensation circumferential groove 335, a piston side fluid bearing (forward annular nozzle arrangement 330") or with combinations thereof as has already been described in conjunction with the first variant of the third embodiment.

The piston cylinder unit according to the invention, and this also applies for all embodiments, forms an element of a linear compressor in an advantageous embodiment, wherein the compressed fluid is a gas, for example air. The fluid bearings are thus configured as gas pressure bearings, for example air bearings. An advantageous embodiment is a refrigeration system linear compressor wherein the fluid is a gaseous refrigerant.

The invention is not limited to the embodiments recited supra which only provide a general description of the core idea of the invention. Within the scope of the invention the device according to the invention can also be provided in embodiments that differ from the embodiments recited supra. The device can thus in particular include features which represent a combination from the respective individual features of the patent claims.

Reference numerals in the patent claims, the description and the drawings are intended for better comprehension of the invention and do not limit the scope thereof.

What is claimed is:

1. A piston-cylinder unit, comprising:

a piston that is fluid pressure supported and movable in a linear manner in a cylinder, wherein the cylinder, a face wall of the piston and a face wall of the cylinder define a compression cavity which is at a minimum size in a portion of a top dead center of the piston, wherein the compression cavity is connected in a fluid transferring manner with a bearing gap which is formed between a cylinder inner circumferential wall and a piston outer circumferential wall, wherein a plurality of fluid outlet nozzles are arranged in at least one cross-sectional plane of the cylinder in the cylinder inner circumferential wall along the circumference, which fluid outlet nozzles open into the bearing gap, wherein the piston is provided with a ventilation groove configured as a circumferential groove into which a ventilation conduit opens, wherein the ventilation groove is configured in a circumferential section of the piston that is adjacent to the piston face wall, wherein the ventilation conduit reduces pressurized fluid entering the ventilation groove to a pressure level which is lower than a pressure in the compression cavity when the piston is in its top dead center or when it moves towards the top dead center in proximity to the top dead center, and wherein a pressure compensation circumferential groove is provided between the piston face wall and the ventilation groove.

2. The piston-cylinder unit according to claim 1, wherein the ventilation groove is in fluid transferring connection with a cavity where the lower pressure level is provided.

3. The piston-cylinder unit according to claim 1, wherein the piston includes a piston section with a reduced diameter in the portion of the piston face wall, and wherein the ventilation groove is provided with a non-reduced diameter in a remaining piston portion.

4. The piston-cylinder unit according to claim 1, wherein the diameter of the piston section with the reduced diameter increases in axial direction of the piston starting from the piston face wall.

5. The piston-cylinder unit according to claim 4, wherein an increase of the diameter in the piston section with the reduced diameter is linear.

6. The piston-cylinder unit according to claim 4, wherein an increase of the diameter in the piston section with reduced diameter is non-linear.

7. A piston-cylinder unit, comprising:

a piston that is fluid pressure supported and movable in a linear manner in a cylinder, wherein the cylinder, a face wall of the piston and a face wall of the cylinder define a compression cavity which is at a minimum size in a portion of a top dead center of the piston, wherein the compression cavity is connected in a fluid transferring manner with a bearing gap which is formed between a cylinder inner circumferential wall and a piston outer circumferential wall, wherein a plurality of fluid outlet nozzles are arranged in at least one cross-sectional plane of the cylinder in the cylinder inner circumferential wall along the circumference, which fluid outlet nozzles open into the bearing gap, wherein the piston is provided with a ventilation groove configured as a circumferential groove into which a ventilation conduit open, wherein the ventilation groove is configured in a circumferential section of the piston that is adjacent to the piston face wall, wherein the ventilation conduit reduces pressurized fluid entering the ventilation groove to a pressure level which is lower than a pressure in the compression cavity when the piston is in its top dead center or when it moves towards the top dead center in proximity to the top dead center, wherein a plurality of fluid outlet nozzles is arranged in the piston outer circumferential wall along the circumference at least in one cross sectional plane of the piston on a side of the ventilation groove that is oriented away from the piston face wall, and wherein the plurality of fluid outlet nozzles opens into the bearing gap.

8. The piston-cylinder unit according to claim 7, wherein the at least one cross sectional plane of the piston with the fluid outlet nozzles is arranged in any position of the reciprocating piston between the at least one cross sectional plane of the cylinder with the fluid outlet nozzles and the cylinder face wall.

9. A piston-cylinder unit, comprising:

a piston that is fluid pressure supported and movable in a linear manner in a cylinder, wherein the cylinder, a face wall of the piston and a face wall of the cylinder define a compression cavity which is at a minimum size in a portion of a top dead center of the piston, wherein the compression cavity is connected in a fluid transferring manner with a bearing pap which is formed between a cylinder inner circumferential wall and a piston outer circumferential wall, wherein a plurality of fluid outlet nozzles are arranged in the cylinder inner circumferential wall along a circumference at least in a cross sectional plane of the cylinder where the fluid outlet nozzles open into the bearing gap, wherein a section of the bearing gap that is adjacent to the compression cavity has a greater radial extension than a section of the bearing gap that is oriented away from the compression cavity, at least when the piston approaches to dead center, and wherein the section of the bearing gap with the greater radial extension is formed by a cylinder section with an increased diameter.

10. The piston-cylinder unit according to claim 9, wherein the section of the bearing gap with the greater radial extension is formed by a piston section with a reduced diameter.

11. The piston-cylinder unit according to claim 10, wherein a diameter of the piston section with the reduced diameter increases starting from the piston face wall in axial direction of the piston.

12. The piston-cylinder unit according to claim 11, wherein a diameter increase in the piston section with the reduced diameter is linear.

13. The piston-cylinder unit according to claim 11, wherein the diameter increase in the piston section with reduced diameter is non-linear.

14. The piston-cylinder unit according to claim 9, wherein the diameter of the cylinder section with the increased diameter decreases from the cylinder face wall in an axial direction of the cylinder.

15. The piston-cylinder unit according to claim 14, wherein a decrease of the diameter in the cylinder section with the increased diameter is linear.

16. The piston-cylinder unit according to claim 14, wherein a decrease of the diameter in the cylinder section with increased diameter is non-linear.

17. The piston-cylinder unit according to claim 9, wherein a plurality of fluid outlet nozzles are arranged in the piston outer circumferential wall along a circumference at least in a cross sectional plane of the piston, the piston face wall or adjacent to the face side piston section with reduced diameter, and wherein the fluid outlet nozzles open into the bearing gap.

18. The piston-cylinder unit according to claim 17, wherein the at least one cross sectional plane of the piston with the fluid outlet nozzles is arranged in any position of the reciprocating piston between the at least one cross sectional plane of the cylinder with the fluid outlet nozzles and the cylinder face wall.

19. A piston-cylinder unit, comprising:

a piston that is fluid pressure supported and movable in a linear manner in a cylinder, wherein the cylinder, a face wall of the piston and a face wall of the cylinder define a compression cavity which is at a minimum size in a portion of a top dead center of the piston, wherein the compression cavity is connected in a fluid transferring manner with a bearing gap which is formed between a cylinder inner circumferential wall and a piston outer circumferential wall, wherein a plurality of fluid outlet nozzles are arranged in the cylinder inner circumferential wall along a circumference at least in a cross sectional plane of the cylinder where the fluid outlet nozzles open into the bearing gap, wherein a section of the bearing gap that is adjacent to the compression cavity has a greater radial extension than a section of the bearing gap that is oriented away from the compression cavity, at least when the piston approaches top dead center, wherein the piston is provided with at least one circumferential groove in a circumferential section that is adjacent to the piston face wall or the piston section with reduced diameter, and wherein at least one circumferential groove of the piston is configured as a ventilation groove into which a ventilation conduit opens.

20. The piston-cylinder unit according to claim 19, wherein the ventilation conduit is in fluid transferring connection with a space in which a fluid pressure is provided that is lower than the pressure in the compression cavity when the piston is in its top dead center or moves towards its top dead center.

21. The piston-cylinder unit according to claim 19, wherein the ventilation groove is configured in a circumferential section of the piston that is adjacent to the piston face wall or the piston section with the reduced diameter.

22. The piston-cylinder unit according to claim 7, wherein the ventilation groove is in fluid transferring connection with a cavity where the lower pressure level is provided.

23. The piston-cylinder unit according to claim 19, wherein the section of the bearing gap with the greater radial extension is formed by a piston section with a reduced diameter.

24. The piston-cylinder unit according to claim 23, wherein a diameter of the piston section with the reduced diameter increases starting from the piston face wall in axial direction of the piston.

25. The piston-cylinder unit according to claim 24, wherein a diameter increase in the piston section with the reduced diameter is linear.

26. The piston-cylinder unit according to claim 24, wherein the diameter increase in the piston section with reduced diameter is non-linear.

* * * * *